US008602173B2

(12) United States Patent
Berner

(10) Patent No.: US 8,602,173 B2
(45) Date of Patent: Dec. 10, 2013

(54) MONITORING SUPPORTS IN ELEVATOR INSTALLATIONS

(75) Inventor: Oliver Berner, Sursee (CH)

(73) Assignee: Inventio AG, Hergiswil (CH)

( * ) Notice: Subject to any disclaimer, the term of this patent is extended or adjusted under 35 U.S.C. 154(b) by 422 days.

(21) Appl. No.: 13/088,858

(22) Filed: Apr. 18, 2011

(65) Prior Publication Data

US 2011/0253484 A1 Oct. 20, 2011

(30) Foreign Application Priority Data

Apr. 19, 2010 (EP) ..... 10160323

(51) Int. Cl.
*B66B 1/34* (2006.01)

(52) U.S. Cl.
USPC ..... 187/393; 187/411; 187/250

(58) Field of Classification Search
USPC ..... 187/247, 248, 251, 254, 256, 258, 264, 187/266, 277, 350, 359, 361, 391–393, 401, 187/403, 406, 408, 411, 412; 73/1.09, 1.13, 73/1.15, 763, 783, 796, 811, 828; 177/132, 142, 147
See application file for complete search history.

(56) References Cited

U.S. PATENT DOCUMENTS 4,106,594 A * 8/1978 Kirsch et al. ..... 187/278
4,467,895 A * 8/1984 Smith et al. ..... 187/391
6,123,176 A * 9/2000 O'Donnell et al. ..... 187/393
6,715,587 B2 * 4/2004 Sittler et al. ..... 187/401
7,207,421 B2 * 4/2007 Aulanko et al. ..... 187/266
7,665,580 B2 * 2/2010 Stocker et al. ..... 187/266
7,802,658 B2 * 9/2010 Aulanko et al. ..... 187/266
7,926,622 B2 * 4/2011 Henneau ..... 187/393
8,123,002 B2 * 2/2012 Smith et al. ..... 187/393
8,162,110 B2 * 4/2012 Smith et al. ..... 187/393
2011/0088980 A1 * 4/2011 Husmann ..... 187/249
2012/0152663 A1 * 6/2012 Legeret et al. ..... 187/404
2012/0222490 A1 * 9/2012 Fischer ..... 73/828

FOREIGN PATENT DOCUMENTS

EP 1953108 A1 8/2008
WO 2007144456 A1 12/2007

* cited by examiner

*Primary Examiner* — Anthony Salata

(74) *Attorney, Agent, or Firm* — Fraser Clemens Martin & Miller LLC; William J. Clemens

(57) ABSTRACT

An elevator installation can comprise an elevator cage, a counterweight, a first support, a second support, a drive for driving of drive pulleys in common and for movement of the supports, and a monitoring device with two slack support switches. A first slack support switch is arranged in the region of a first fastening point for monitoring the first support. A second slack support switch is arranged diagonally opposite in the region of another fastening point for monitoring the second support. The monitoring device comprises a safety circuit, in which the two slack support switches are so integrated in a safety circuit of the elevator installation that actuation of just one of the two slack support switches interrupts the safety circuit.

11 Claims, 2 Drawing Sheets

MONITORING SUPPORTS IN ELEVATOR INSTALLATIONS

CROSS-REFERENCE TO RELATED APPLICATION

This application claims priority to European Patent Application No. 10160323.1, filed Apr. 19, 2010, which is incorporated herein by reference.

FIELD

The present disclosure relates to monitoring a support in an elevator installation.

BACKGROUND

An elevator installation usually comprises an elevator cage and a counterweight, which are moved in opposite directions in an elevator shaft. The elevator cage and the counterweight in this regard run along guide rails and are supported by at least one support means, which is guided over a driving drive pulley. The support means usually consists of one or more sheathed or unsheathed steel cables, one or more synthetic fiber cables, one or more flat or profiled belts (for example wedge-ribbed belts) or a parallel extending composite of the respective mentioned constructions, in which each individual support means can be guided over a respective individual drive pulley or a common drive shaft.

A very high traction on the driving drive pulley/drive shaft can be realized by modern support means, for example, when use is made of support means which are sheathed by synthetic material and which have a significantly higher coefficient of friction by comparison with classic steel cables.

Due to the high level of traction it is possible, for example, to continue raising the elevator cage although the counterweight could be blocked in its downward movement by unexpected jamming in the elevator shaft or unexpected seating on the shaft floor buffers. The same problem can arise with the counterweight if the elevator cage should sit on the shaft floor buffers. This lifting up of a load—be it the elevator cage or the counterweight—at one side of the drive pulley without the intended counter-load running conjunctively to freely drop at the other side of the drive pulley is undesired and can lead to risk-laden states, for example, dropping down of the elevator cage or the counterweight or tripping of maintenance personnel in the shaft head.

In correspondence with various regulatory standards and due to safety considerations use is therefore made of numerous so-termed slack-cable switches for recognition of corresponding risk situations in the elevator installation. Different risk situations can thus be recognized depending on the arrangement and construction of these switches.

Consequently, monitoring devices for detection of an unloaded, slack support means have been developed. They can be based, as disclosed in, for example, European application EP-A1-1 953 108, on a spring-reinforced mounting of the entire drive and a deflecting unit with at least two further rollers for the support means. This approach can be very costly.

International application WO-A1-2007/144456 discloses a direct, spring-reinforced version of the support means. WO-A1-2007/144456 discloses elevator equipment with an elevator cage, a counterweight and a 2:1 support means guidance, wherein an individual switch for detection of support means slackness is provided at each support means end. A relaxation, which arises at the fastening point of the support means due to load relief thereof, of a spring triggers the switch, which switches off the drive.

The disadvantages of these two prior art solutions can include on the one hand the constructional complication and on the other hand the costs.

SUMMARY

At least some embodiments of technologies disclosed herein provide a monitoring device for detection of slack in support means of an elevator installation. In some cases, these embodiments provide a simpler and more economic construction and avoid the stated disadvantages of the prior art. Some embodiments provide detection of a support means that has become slack due to a disturbance. At least some embodiments address one or more issues described above, but a given embodiment is not required to solve one or more problems or address one or more disadvantages.

In further embodiments, a so-termed diagonal arrangement of slack support means switches is provided. In that case, a certain level of safety can be achieved, although the number of switches required has been halved compared to one or more other technologies.

Some embodiments include the conception and arrangement of a monitoring device in which a first slack support means switch is arranged at a first support means run, for example at the run end at the counterweight side, and a second slack support means switch is arranged at a second support means run, for example at the run end at the cage side. Compared to at least some prior art systems, it is possible to save two slack support means switches without losses in safety.

In some cases, two fixed fastening points can be defined at which a support means is fastened, for example in the upper region of the elevator shaft, in stationary position. The support means is, for example, guided over a drive pulley or a common drive shaft and thus forms two loops. The elevator cage is supported in one of these by at least one support roller and the counterweight is supported in the other by at least one support roller.

The support means thus forms several support means sections or support means lengths which during operation of the elevator installation vary in their respective length. The support means sections lie between respective engagement or force application points. Thus, for example, a first support means section of the overall support means is formed between one of the stationary fastening points and a counterweight support roller of the counterweight or an engagement point of the support means at the counterweight.

A second support means section of the overall support means is formed between the counterweight support roller of the counterweight or the engagement point of the support means at the counterweight and the drive pulley. This second support means section is also termed support means section at the counterweight side in the following.

A third support means section of the overall support means is formed between the drive pulley and an engagement point of the support means at the elevator cage or a cage support roller of the elevator cage. This third support means section is also termed support means section of the cage side in the following.

A fourth, and possibly last, support means section of the overall support means is formed between the cage support roller of the elevator cage or the engagement point of the support means at the elevator cage or—if the elevator cage is underslung or supported by at least two cage support rollers—a second cage support roller of the elevator cage or a second engagement point of the support means at the elevator cage and the other stationary fastening point.

Proposals for a solution from the prior art, such as disclosed, for example, in International published specification WO-A1-2007/144456, sometimes provide an abutment for the normal operational state with loaded support means.

Some embodiments of monitoring devices described herein provide a slack support means switch which in the normal operational state is switched on, i.e., closed. However, as soon as one of the support means slackens, the slack support means switch is interrupted, i.e., opened.

At least some embodiments can enable monitoring of all critical states in an elevator installation with a minimum of slack support means switches. The construction can be simple, robust and reliable.

BRIEF DESCRIPTION OF THE DRAWINGS

The disclosed technologies are explained in more detail symbolically and by way of example on the basis of figures. The figures are described conjunctively and in general. The same reference numerals signify the same components and reference numerals with different indices indicate functionally equivalent or similar components.

In that case.

DETAILED DESCRIPTION

Figure 1:
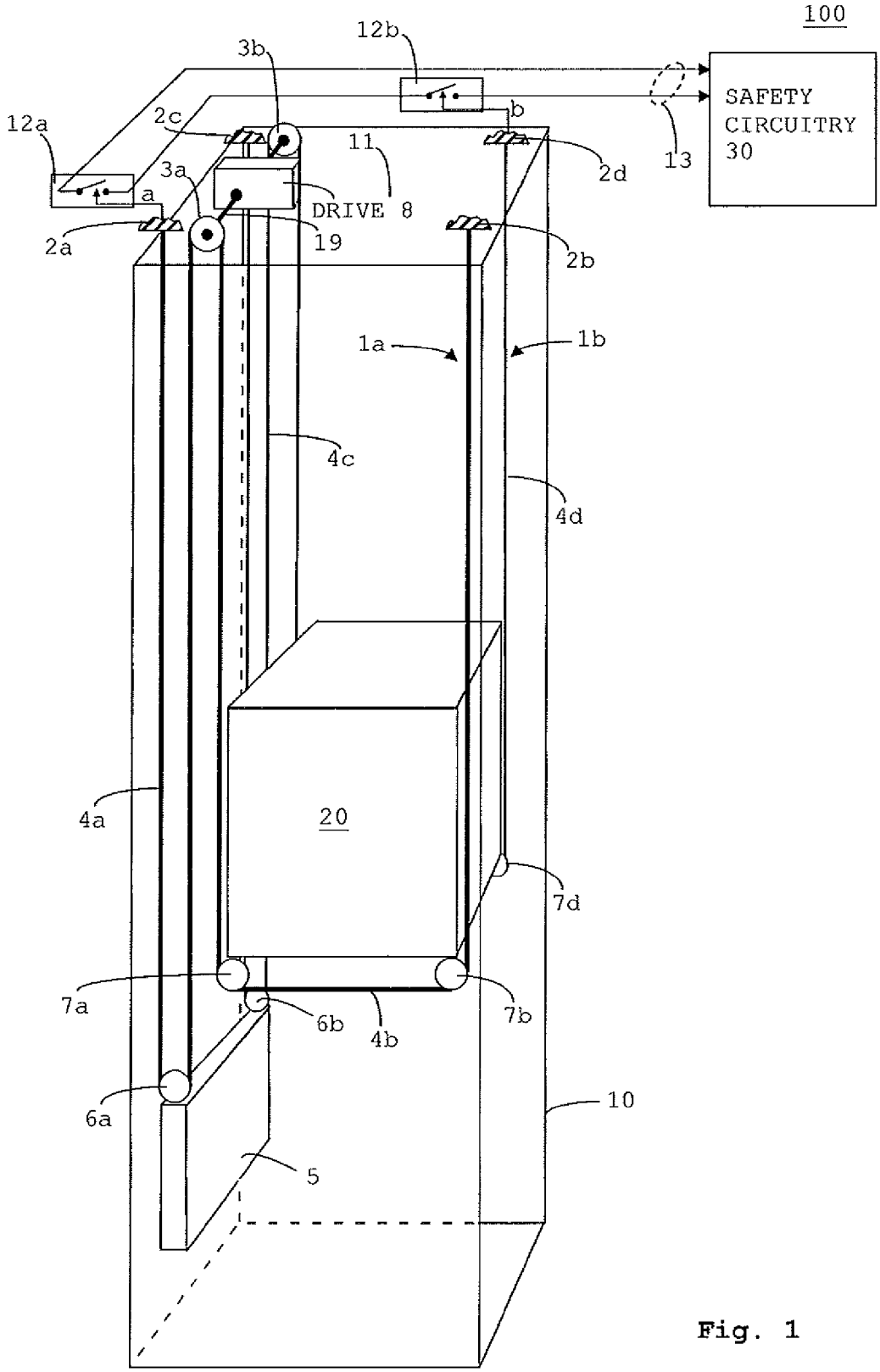
FIG. 1 shows a schematic illustration of a part of an elevator installation with an elevator cage and a counterweight, which move in opposite directions, in a 2:1 constellation with two parallel extending support means.

FIG. 1 shows a schematic perspective illustration of a part of an elevator installation 100 comprising an elevator cage 20 and a counterweight 5, which move in opposite directions, in a 2:1 constellation with two parallel extending support means 1*a*, 1*b*. A front support means 1*a* forms, from a first fastening point 2*a* at the shaft ceiling 11 of the elevator shaft 10 up to the drive pulley 3*a*, a support loop 4*a* in which the counterweight 5 runs by means of a counterweight support roller 6*a*. This form of suspension of the counterweight represents a 2:1 suspension.

By the term "drive pulley" 3*a*, 3*b* there is also meant here a drive shaft which is made of one piece and over which the two support means 1*a*, 1*b* run.

The support means 1*a* additionally forms, from the drive pulley 3*a* up to a second fixed point 2*b* at the shaft ceiling 11, a second support loop 4*b* in which the elevator cage 20 is carried on cage support rollers 7*a* and 7*b*. This form of suspension also represents a 2:1 suspension for the elevator cage 20.

The rear support means 1*b* adopts a corresponding course. Starting from the fastening point 2*c* at the shaft ceiling 11 of the elevator shaft 10 up to the drive pulley 3*b* the rear support means 1*b* forms a support loop 4*c* in which the counterweight 5 runs by means of a counterweight support roller 6*b*. The support means 1*b* additionally forms, from the drive pulley 3*b* up to a second fixed point 2*d* at the shaft ceiling 11, a second support loop 4*d* in which the elevator cage 20 is carried on cage support rollers 7*c* and 7*d* (the cage support roller 7*c* cannot be seen here since it is arranged behind and below the elevator cage 20).

Further details of the exemplifying elevator installation 100 according to FIG. 1 are described in the following. Only an upper section of the elevator shaft 10 is shown in FIG. 1. In order to be able to better illustrate the course of the support means 1*a* and 1*b*, the counterweight 5 was illustrated somewhat below the elevator cage 20, although the counterweight 5 would actually have had to have reached the shaft floor (not able to be seen) when the elevator cage 20 approaches the shaft ceiling 11, i.e., an uppermost stopping position. Two counterweight support rollers 6*a* and 6*b* are provided at the counterweight 5 here in the region of the upper side. These counterweight support rollers 6*a* and 6*b* are seated in the support means loops 4*a* and 4*c*. The elevator cage 20 here has underslinging. For this purpose four cage support rollers 7*a*, 7*b*, 7*c* and 7*d* are arranged below the elevator cage 20. The elevator cage 20 is seated by these cage support rollers 7*a*, 7*b*, 7*c* and 7*d* in the two support means loops 4*b*, 4*d*. The fastening points 2*a*, 2*b*, 2*c* and 2*d* are here seated in the region of the shaft ceiling 11. However, the fastening points can also be mounted at, for example the shaft walls of the elevator shaft 10 or at another stationary, stable structure, for example at cross members or a frame.

The two drive pulleys 3*a*, 3*b* can be driven by a common drive 8. In the illustrated example, they are for this purpose seated on a continuous shaft 19, which is seated coaxially with respect to the axes of rotation of the drive pulleys 3*a*, 3*b*.

The slack support means switches 12*a*, 12*b* are indicated purely schematically in FIG. 1 by block circuit diagrams with switch symbols. The operative connection or the action of the respective support means 1*a*, 1*b* with or on these slack support means switches 12*a*, 12*b* is indicated by arrows a, b, which point to the switch symbol. The support means 1*a* triggers the slack support means switch 12*a* in the event of a disturbance and the support means 1*b* triggers the slack support means switch 12*b* in the event of a disturbance.

The two slack support means switches 12*a*, 12*b* are so connected in series that opening of just one of the two slack support means switches 12*a*, 12*b* interrupts a safety circuit 13 of the elevator installation 100. The series connection of the two slack support means switches 12*a*, 12*b* is symbolized in FIG. 1 by two lines, which communicate with a safety circuit 30 (here illustrated as a block). When the two slack support means switches 12*a*, 12*b* are closed (which is the case in normal operation), the safety circuit 13 is then closed and conducts current. If one or both slack support means switches 12*a*, 12*b* opens or open, the safety circuit 13 is then interrupted (termed disturbance case).

In some cases, for recognition of support means breakages it can be necessary for each support means 1*a* and 1*b* to be monitored by a switch (here termed slack support means switches 12*a*, 12*b*). This switch can be so constructed and arranged that in the case of slackening (breakage) of the support means 1*a* or 1*b* it responds. For recognition of "support means breakages" it is in that case not necessarily critical whether this form of monitoring takes place at the first support means 1*a*, for example at a first fastening point 2*a* on the counterweight side, or at a second fastening point 2*b* on the cage side. This means that for recognition of a support means breakage only one switch is needed for each support means 1*a*, 1*b* and can be arranged at a desired end.

For recognition of an unintended raising of the elevator cage 20 when the counterweight 5 is blocked (termed "stalling"), a slack support means switch 12*a*, 12*b* is arranged on the counterweight side, i.e., at the first fastening point 2*a* or the fastening point 2*c*. If, in particular, the elevator cage 20 when the counterweight 5 is blocked is conveyed further upwardly due to the good traction at the drive pulleys 3*a*, 3*b*, then the support loops 4*a* and 4*c* at the counterweight side slacken. This is recognizable in that a slack support means switch is arranged either at the fastening point 2*a* or at the fastening point 2*c*.

For recognition of unintended raising of the counterweight 5 when the elevator cage 20 is blocked (termed "stalling"), the slack support means switch 12*a*, 12*b* is arranged on the cage side, i.e., in this case the slack support means switch 12*a*, 12*b* is arranged in the region of the second fastening point 2*b* or fourth fastening point 2*d*.

Since, however, in addition to the demands which result from monitoring stalling, a monitoring of a possible support means breakage is also carried out, a diagonal arrangement of the slack support means switches 12*a*, 12*b* can be used. Either the support means switches 12*a*, 12*b* are seated diagonally at the fastening points 2*a* and 2*d*, as shown in FIG. 1, or they are seated diagonally at the fastening points 2*b* and 2*c* (not shown). Thus, only one slack support means 12*a*, 12*b* is required for each support means 1*a*, 1*b*.

As can be understood on the basis of FIG. 1, the following trigger situations can arise in the case of an elevator installation 100 with 2:1 suspension and two parallel extending support means 1*a*, 1*b*:

| Disturbance case | Slack support means switch 12a | Slack support means switch 12b |
|---|---|---|
| Breakage of support means 1a | trigger | |
| Breakage of support means 1b | | trigger |
| Counterweight 5 blocked | trigger, since support means 1a is slack | |
| Elevator cage 20 blocked | | trigger, since support means 1b is slack |

Figure 2:
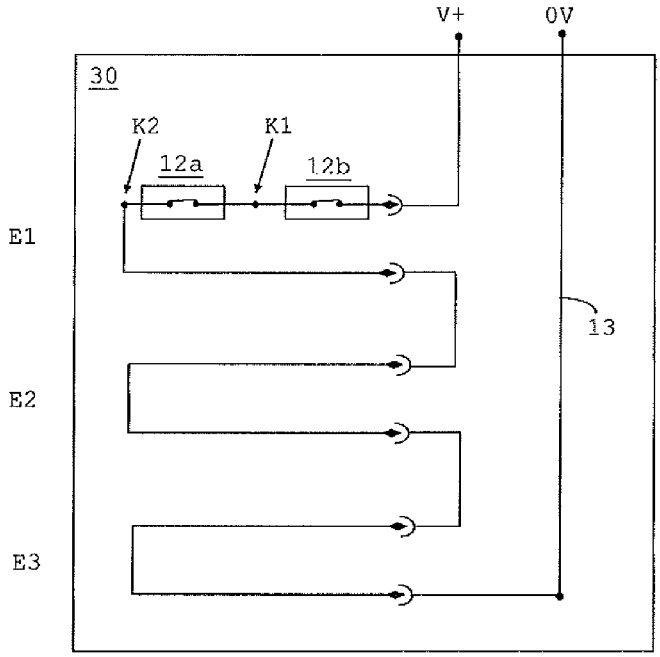
FIG. 2 shows a schematic illustration of a safety circuit of one form of embodiment of an elevator installation.

Details of a safety circuit of an elevator installation 100 are shown in FIG. 2 in a schematic block illustration. The block circuit diagram in FIG. 2 shows an example of a simple safety circuit 13. One or more safety-relevant functions in the elevator installation 100 are monitored, perhaps continuously, by the safety circuit 13 of the safety circuitry 30. Typically, there are different planes, which are monitored in dependence on the respective operational state of the elevator installation 100. An example with three planes E1, E2 and E3 is illustrated in FIG. 2, wherein the switches of the planes E2 and E3 are not shown.

The slack support means switches 12*a* and 12*b* are arranged in the 1st plane E1 and in this embodiment are here connected in series. The two slack support means switches 12*a*, 12*b* are closed, which means that none of the slack support means switches 12*a*, 12*b* has triggered (normal operational state).

In another embodiment the two slack support means switches 12*a*, 12*b* are, however, arranged in the safety circuit 13 on different planes (such as, for example, the planes E1 and E2). It is not necessary for the slack support means switches 12*a*, 12*b* to always be physically connected in series. In terms of function, however, there can be a series connection in every case, since each of the slack support means switches 12*a*, 12*b* can interrupt the safety circuit 13.

For normal travel operation in the normal operational state it can be necessary, for example, that all safety switches (i.e. also the slack support means switches 12*a*, 12*b*) or the entire safety circuit 13 is or are closed.

The safety circuit 13 is here supplied with a direct voltage V+. The second conductor (return conductor) lies at, for example, 0 volts. If one of the switches in the safety circuit 13, for example one of the two slack support means switches 12*a*, 12*b*, opens, for example due to a support means breakage or a stalling situation, then the current flow in the safety circuit 13 is interrupted and it can trigger a relay, transistor or other switching element (not shown) in order to bring about an emergency stop.

As can be the case of all switches of the safety circuit 13, the slack support means switches 12*a*, 12*b* are also executed as 'openers', i.e., on triggering of the slack support means switches 12*a*, 12*b* (trigger situations according to the table), the slack support means switches 12*a*, 12*b* are opened and thus the safety circuit 13 is interrupted.

For set-up operation, for an evacuation or for inspection purposes it is not necessary in certain circumstances for all planes of the safety circuit 30 to be closed.

Figure 3A:
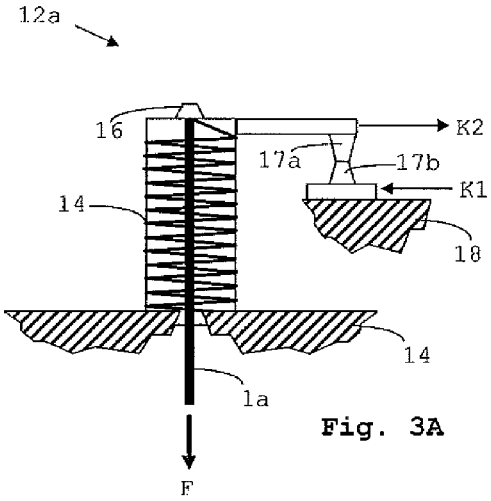
FIG. 3A shows a schematic side view of a slack support means switch, in a closed state (normal operational state)
Figure 3B:
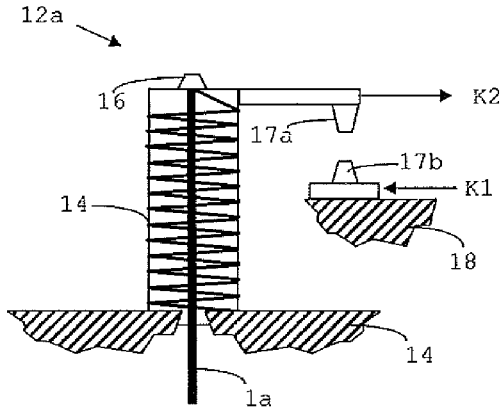
FIG. 3B shows a schematic side view of the slack support means switch, in accordance with FIG. 3B, in an opened state (disturbance case).

A slack support means switch 12*a* is shown in FIGS. 3A and 3B in exemplifying, schematic form. The slack support means switch 12*a* here comprises a spring body 14 which is supported on the lower side relative to a bracket 15 or another stationary component. The support means 1*a* runs centrally through the spring body 14 and is fastened at an upper side to a fastening point 16. This fastening point 16 corresponds, for example, with the first fastening point 2*a*. A 1st contact 17*a* is provided at the spring body 14. A 2nd contact 17*b* is seated opposite at a bracket 18 or another stationary component. When the support means 1*a* is loaded in tension, as illustrated in FIG. 3A by the tension force F, the spring body 1 is then compressed and the 1st contact 17*a* moves downwardly. In this case the 1st contact 17*a* sits on the contact 17*b* and a conductive connection is produced. The electrical contact points K1 and K2 are connected and the switch 12*a* is closed.

FIG. 3B shows the situation after a support means breakage of the support means 1*a*. A sufficiently large tension force F is no longer present and the spring body 14 expands. The 1st contact 17*a* thereby shifts upwardly and the electrically conductive connection between K1 and K2 is interrupted. Since this slack support means switch 12*a* lies in the safety circuit 13, as shown in FIG. 2, the safety circuit 13 in FIG. 3B would open and the elevator installation 100 would stop.

The slack support means switches 12*a*, 12*b* can, however, also be of different construction. Instead of compression of a spring or of a spring body 14, use can also be made in normal operation of a tension loading or elongation of a spring or a spring body in order to realize a slack support means switch. Other current slack support means switches are also usable with at least some of the disclosed technologies, wherein the slack support means switches can be designed so that they are always closed in normal operation and opened in the case of disturbance.

Some embodiments can also be used on an elevator installation 100 with four support means. In this case, only four slack support means switches are required, of which a respective one is used for each support means. Overall, these four slack support means switches are again to be arranged diagonally in pairs.

Further embodiments can also be used on an elevator installation 100 in which the elevator cage 20 is not underslung. In this case the cage support rollers are seated on the upper side of the elevator cage 20. However, in at least some cases, nothing is thereby changed with respect to the arrangement of the slack support means switches.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation, comprising:

an elevator cage disposed in an elevator shaft;

a counterweight disposed in the elevator shaft;

a first support, the first support extending from a first fastening point in the elevator shaft to the counterweight, from the counterweight to a drive, from the drive to the elevator cage, and from the elevator cage to a second fastening point in the elevator shaft;

a second support, the second support extending from a third fastening point in the elevator shaft to the counterweight, from the counterweight to the drive, from the drive to the elevator cage, and from the elevator cage to a fourth fastening point in the elevator shaft, the first and fourth fastening points being positioned diagonally opposed from each other in the elevator shaft; and a monitoring device, the monitoring device comprising, a first slack support switch, the first slack support switch being coupled to the first support near the first fastening point and configured to monitor the first support, a second slack support switch, the second slack support switch being coupled to the second support near the fourth fastening point and configured to monitor the second support, and a safety circuit, the safety circuit being coupled to the first and second slack support switches, wherein an actuation of at least one of the first or second safety switches interrupts the safety circuit.

2. The elevator installation of claim 1, wherein the first and second slack support switches are arranged in a series.

3. The elevator installation of claim 1, wherein the first slack support switch comprises means for measuring a load on first support.

4. The elevator installation of claim 1, wherein the first slack support switch is configured to be electrically closed by a force on the first support, and wherein the second slack support switch is configured to be electrically closed by a force on the second support.

5. The elevator installation of claim 1, wherein the first slack support switch is configured to be electrically opened as a result of a lessening of a force on the first support, and wherein the second slack support switch is configured to be electrically opened as a result of a lessening of a force on the second support.

6. The elevator installation of claim 5, wherein the lessening of the force on the first support is caused by a fracture of the first support or wherein the lessening of the force on the second support is caused by a fracture of the second support.

7. The elevator installation of claim 5, wherein the lessening of the force on the first support is caused by a stalling of the counterweight or wherein the lessening of the force on the second support is caused by a stalling of the elevator cage.

8. The elevator installation of claim 1, wherein exactly one slack support switch is coupled to the first support and exactly one slack support switch is coupled to the second support.

9. The elevator installation of claim 1, wherein the first support and the second support run underneath the elevator cage.

10. A method for operating an elevator installation, comprising:

monitoring a first support using a first slack support switch, the first support extending from a first fastening point in an elevator shaft to a counterweight and to an elevator cage, and from the elevator cage to a second fastening point in the elevator shaft, the first slack support switch being located near the first fastening point; and monitoring a second support using a second slack support switch, the second support extending from a third fastening point in the elevator shaft to the counterweight and to the elevator cage, and from the elevator cage to a fourth fastening point in the elevator shaft, the second slack support switch being located near the fourth fastening point, the first and fourth fastening points being positioned diagonally opposed from each other in the elevator shaft.

11. An elevator apparatus, comprising:

a first linear elevator support coupled to a first counterweight-side fastening point in an elevator shaft and a first cage-side fastening point in the elevator shaft, the first linear elevator support being coupled to a counterweight and an elevator cage between the first counterweight-side fastening point and the first cage-side fastening point;

a second linear elevator support coupled to a second counterweight-side fastening point in the elevator shaft and a second cage-side fastening point in the elevator shaft, the second linear elevator support being coupled to the counterweight and the elevator cage between the second counterweight-side fastening point and the second cage-side fastening point;

a first slack sensor coupled to the first linear elevator support near the first counterweight-side fastening point; and a second slack sensor coupled to the second linear elevator support near the second cage-side fastening point.

* * * * *